US005322543A

United States Patent [19]

Lazcano-Navarro

[11] Patent Number: 5,322,543

[45] Date of Patent: Jun. 21, 1994

[54] SIMPLIFIED METHOD FOR PRODUCING DUCTILE IRON

[76] Inventor: Arturo Lazcano-Navarro, Blvd. Harold R. Pape #1811, Monclova, Coahuila 25750, Mexico

[21] Appl. No.: 13,432

[22] Filed: Feb. 4, 1993

[51] Int. Cl.[5] ..... C22C 33/08

[52] U.S. Cl. ..... 75/10.15; 420/18; 420/19

[58] Field of Search ..... 420/18-25; 75/10.15

[56] References Cited

U.S. PATENT DOCUMENTS 3,295,960 1/1967 Parlee ..... 420/19

4,537,629 8/1985 Lazcano-Navarro ..... 420/19

4,592,538 6/1986 Wells ..... 420/18

*Primary Examiner*—Peter D. Rosenberg

*Attorney, Agent, or Firm*—Laurence R. Brown

[57] ABSTRACT

A method for producing ductile iron in a single reactor without the utilization of further processor like converters, tundishes, plunging etc. is disclosed. The method is applied in a modified induction furnace with a removable bottom injection device stainless steel tuyere type wherein it is possible to inject different gases like nitrogen, argon, chlorine, natural gas and solids like Magnesium, alloying, innoculants, desulfurization agents etc. through pneumatic transportation.

8 Claims, 1 Drawing Sheet

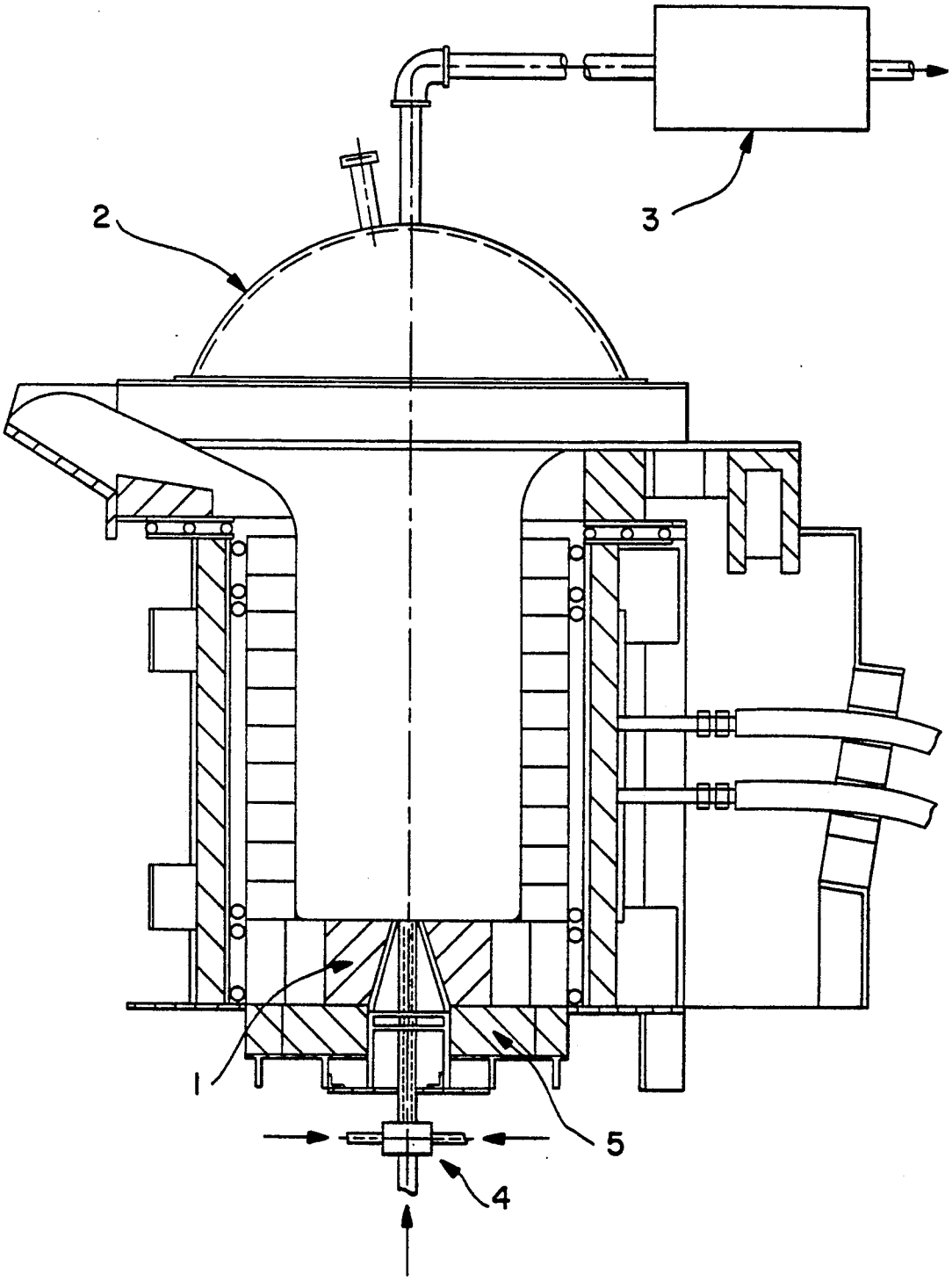
2
3
1
5
4

SIMPLIFIED METHOD FOR PRODUCING DUCTILE IRON

BACKGROUND OF THE INVENTION

Most all the actual methods for producing ductile iron involve two, three or more reactors specially for magnesium alloying. This results in a high production cost.

A single reactor method is desirable for reducing energy consumption, pollution, labor and the elimination of complementary equipment for desulfurization and nodulization, as is the optional capability of using high manganese raw materials to reduce iron through chlorine gas injection. Furthermore, the presence of pollution it is desirable to use the existing very acceptable melting facility of all induction furnace. Storing gas stirring gives extra savings in power consumption, yields and better uniformity of chemical composition.

BRIEF DESCRIPTION OF THE DRAWING

The single Figure schematically illustrates a cross section of the modified induction furnace higher with respect to height and diameter to provide reasonable free board to control splashes; a special movable cap (2) in the top to provide hermetic handling of the exhaust gases, a wicker and temperature-sampling device, a removable bottom and a removable injection device of the stainless steel tuyere type; several gases can be injected like nitrogen, argon, chlorine, natural gas and solids through pneumatic transportation like ferrosilicon, magnesium, magnesium-ferrosilicon, calcium carbide, innoculants etc. The exhaust gases can be treated in a conventional cleaning system (3) with the exception of the optional operation to reduce manganese residuals using chlorine gas injection in a second and specific treatment required to neutralize or recover chlorine through a deviation valve in the exhaust connection.

DESCRIPTION OF THE INVENTION

Referring to the drawing the removable injection device stainless steel tuyere type cased in a refractory cone shape (1) is secured in the removable bottom of the furnace (5). Optionally, through the annular space of the tuyere natural gas is injected (4) to assure a coolant to the system. In cases where poststirring is required just before tapping, gas injection can be switched to argon or nitrogen for few minutes.

Through the central space or single pipe tuyere (4) can be injected:

Nitrogen to reduce meltdown time
Desulfurization agents
Chlorine gas to reduce manganese residuals
Nodulizers and innoculants
Argon or nitrogen for post stirring cleaning and homogenization purposes.

Gas injection must be maintained all the time through the several stages of the process, but is reduced to the minimum during tapping.

For better performance in order to avoid dross and non metallic inclusions, it is necessary to stabilish a stirring practice with argon in the transfer ladle.

Exhaust gases are collected through a movable cap (2) which contains a wicker, temperature-sampling system and special sealing coupling to allow charging and tilting during tapping. Finally exhaust gases are treated in a cleaning system (3) before outlet to the atmosphere.

Simplified method of producing ductile iron in a single modified induction furnace using a bottom removable injection device stainless steel tuyere type through where gases and solids are injected in order to carry out all fundamentals operations are involved in processing this product like melting, refining, desulfurizing, desmanganizing, nodulization and innoculation.

Magnesium injection through the bottom provides better control in the reaction, solution with iron, yields, avoiding oxidation and carbide formation due to non contact with atmospheric oxygen and the injection of natural gas which in this particular case has the advantage of a reducing gas and coolant.

Injection of gases and solids through the bottom provides the complementary and necessary operations for producing ductile iron when this method is adapted in duplex to any other source of molten iron like Coupula, induction or electric furnaces.

Gas stirring through a bottom tuyere type device in induction furnaces provides additional benefits in power consumption during melting, and more uniform microstructure in the final product due to a more uniform chemical composition.

Optional chlorine gas bottom injection through the same tuyere type injection device can provide additional benefits in production cost utilizing high manganese content raw materials.

What is claimed is:

1. The method of processing ductile iron comprising the steps of:

providing an induction furnace charged with a source of iron with a bottom region containing a removable injection tuyere coupled with gas and solid sources for injection, injecting solids and gases through said tuyere during production processes of refining, desulfurising, removing manganese, nodulization and innoculation, with continuation gas injection stirring of the furnace contents throughout the production process to lower power consumption and produce uniformity of microstructure and chemical composition in the resulting ductile iron.

2. The method of claim 1 further comprising the steps of:

introducing magnesium through said tuyere in the absence of oxygen to form a solution with the iron contents of the furnace, and injecting natural gas through said tuyere as a reducing gas and coolant.

3. The method of claim 1 further comprising the step of charging the furnace with a source of molten iron.

4. The method of claim 1 further comprising the steps of charging the furnace with high manganese content raw material, and injection chlorine through said tuyere.

5. The method of claim 1 comprising the additional steps of:

providing said induction furnace with a movable cap for hermetically processing exhaust gases, and processing exhaust gases removed from the furnaces in a cleaning system.

6. The method of claim 1 further comprising the steps of:

injecting gases from the group including nitrogen, argon, chlorine and natural gas through said tuyere.

7. The method of claim 1 further comprising the steps of:

injecting solids by pneumatic transportation through said tuyere from the group including ferrasilicon, magnesium and calcium carbide.

8. The method of claim 1 further comprising the steps of:

injecting gas from the group including argon and nitrogen to stair for a few minutes before tapping.

* * * * *